United States Patent [19]

Winyard

[11] Patent Number: 4,628,648

[45] Date of Patent: Dec. 16, 1986

[54] FRAMING STRUCTURE

[75] Inventor: Rodney W. Winyard, Warren, Ohio

[73] Assignee: American Welding & Manufacturing Co., Niles, Ohio

[21] Appl. No.: 683,362

[22] Filed: Dec. 19, 1984

[51] Int. Cl.[4] ..... E06B 1/04

[52] U.S. Cl. ..... 52/212; 52/398; 52/455; 52/771; 52/656; 49/505; 49/DIG. 1

[58] Field of Search ..... 52/212, 397, 398, 656, 52/732, 771, 824, 455; 49/DIG. 1, DIG. 2, 505

[56] References Cited

U.S. PATENT DOCUMENTS

| | | | |
|---|---|---|---|
| 2,268,269 | 12/1941 | Toney et al. | 52/769 |
| 2,877,515 | 3/1959 | Haas | 52/172 |
| 2,902,727 | 9/1959 | Samolis | 52/656 X |
| 2,934,800 | 5/1960 | Hasbrouck et al. | 52/397 |
| 2,970,397 | 2/1961 | Roseman | 49/505 X |
| 3,016,993 | 1/1962 | Owen | 52/397 |
| 3,037,589 | 6/1962 | Cole | 52/212 |
| 3,203,053 | 8/1965 | Lane et al. | 52/212 |
| 3,451,168 | 6/1969 | Pengelly | 49/505 X |
| 3,527,011 | 9/1970 | Bloom et al. | 52/398 |
| 3,694,984 | 10/1972 | Schwartz | 52/398 |
| 3,745,724 | 7/1973 | Gotz | 52/11 |
| 3,750,358 | 8/1973 | Lewkowitz | 52/400 |
| 3,872,638 | 3/1975 | DiFazio | 52/476 |
| 3,981,697 | 9/1976 | Buckthorpe | 52/400 |
| 4,187,657 | 2/1980 | Sukolics | 52/397 |
| 4,259,818 | 4/1981 | Stark | 52/212 X |
| 4,267,673 | 5/1981 | Coulston | 52/97 |
| 4,333,295 | 6/1982 | Janke | 49/DIG. 1 X |
| 4,351,137 | 9/1982 | Enyart et al. | 52/824 X |
| 4,397,124 | 8/1983 | Redman | 52/824 X |

FOREIGN PATENT DOCUMENTS

| | | | |
|---|---|---|---|
| 2130496 | 12/1972 | Fed. Rep. of Germany | 52/398 |
| 110600 | 1/1967 | Norway . | |

*Primary Examiner*—Alfred C. Perham
*Assistant Examiner*—Jean M. LaKemper
*Attorney, Agent, or Firm*—Watts, Hoffmann, Fisher & Heinke Co.

[57] ABSTRACT

An adjustable window framing structure for holding insulated window panes of various thicknesses and characterized by a thermal break between the outside and inside section of the framing structure.

5 Claims, 3 Drawing Figures

FRAMING STRUCTURE

DESCRIPTION

TECHNICAL FIELD

This invention relates generally to a framing structure for mounting a window pane in an opening of a building member and, more particularly, to an adjustable window framing structure for holding insulated window panes of various thicknesses and having a thermal break.

DISCLOSURE OF INVENTION

An object of the invention is to provide a new frame structure for mounting an insulated glass pane in an opening of a building member such as a door, wall panel or the like.

Another object of the invention is to provide a framing structure of the type described which will accommodate glass panes of different thicknesses.

A further object of the invention is to provide a framing structure as described in any of the previous paragraphs which is further characterized by an effective thermal break between the inside and outside sections of the structure.

Still another object of the invention is to provide a framing structure as previously described which can be easily assembled and installed without special fasteners or tools.

The foregoing objects are attained by a frame structure comprised of inside and outside sections which are physically separated to provide a thermal break. Plastic clips attach the sections to each other and hold the sections against the sides of the building. A lock-in molding is carried by the inside section to hold a glass pane within the frame structure. The lock-in molding is adjustable toward and away from the outside section so that glass panes of various thickness may be installed.

Other objects and a full understanding of the invention will be had from the following detailed description and the accompanying drawing.

BEST MODE FOR CARRYING OUT THE INVENTION

Figure 1:
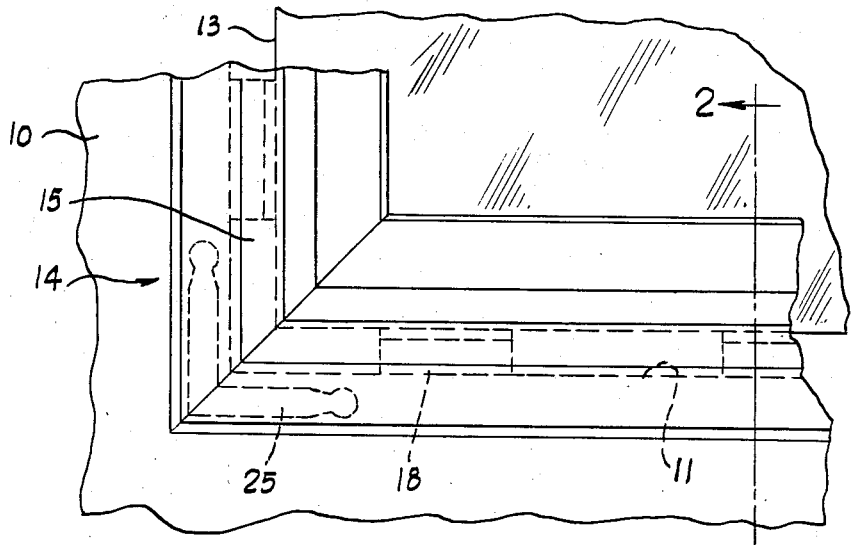
FIG. 1 is a fragmentary elevational view from the outside of the framing structure of the invention mounted in an opening of a building member.

Referring now to the drawings, reference numeral 10 designates a building member, such as a door, wall panel or the like, having a window opening 11. A thermal or insulated glass pane 13 is mounted in the opening 11 by a framing structure 14 constructed in accordance with the present invention.

The framing structure 14 is comprised of an outside peripheral frame 15, an inside peripheral frame 16 and a lock-in molding 17 carried by the frame 16. As will be described in more detail, the lock-in molding 17 is adjustable toward and away from the outside frame 15 in order to accommodate glass panes of different thicknesses. The frames 15, 16 on opposite sides of the building member 10 are connected by spaced apart, nonmetallic clips 18 which are in supporting engagement with the edges of the glass pane 13.

Figure 2:
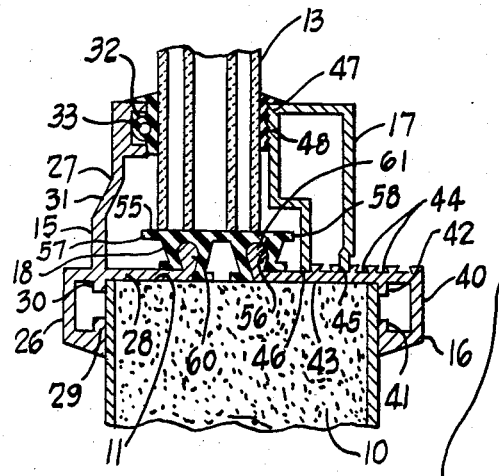
FIG. 2 is a cross-sectional view taken on line 2—2 of FIG. 1.

As most clearly shown in FIG. 2, the outside frame 15 is made up of four sections, each extending along an edge of the window opening 11. The sections of the frame 15 are mitered at their ends and are connected together by L-shaped corner keys 25. In the preferred and illustrated embodiment, each section of the outer frame 15 is comprised of a first perimetrical border section 26 which is engaged against the outside of the building member 10 around the opening 11, a second perimetrical border section 27 which extends around the glass panel 13, and a flange 28 which extends at right angles from the border sections 26, 27 into the window opening 11 against its edge. As shown, the border section 26 of each element of the frame 15 is channel-shaped and includes flanges 29, 30 which extend along the edges of the channel and are engageable against the building member 10. The arms of each corner key 25 are received in driving engagement within the ends of the channel-shaped frame sections 26.

The border section 27 of the frame 15 comprises a web 31 having a groove or channel 32 along its distal edge. The channel 32 carries glazing material 33, such as a vinyl strip, that seals against the glass pane 13.

Figure 3:
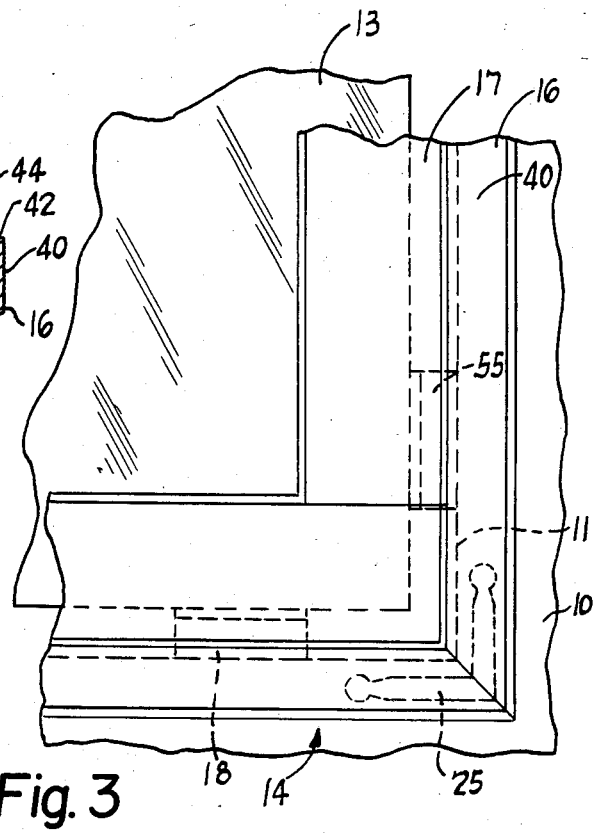
FIG. 3 is a fragmentary elevational view from the inside of the framing structure of the invention mounted in an opening of a building member.

The inner peripheral frame 16 is also made in four sections, each including a channel-shaped border section 40 similar to the border section 26 and including lips 41, 42 engageable against the inside surface of the building member 10. The sections of the frame 16 are mitered and connected together by corner key 25 as shown in FIG. 3.

Each element of the inner frame 16 is further comprised of a flange 43 that is integral with the border section 40 and projects into the window opening 11 against its edge. The flange 43 includes a plurality of lengthwise extending, parallel grooves 44 for adjustably mounting the lock-in molding 17. Each of the elements making up the lock-in molding 17 is shown as being channel-shaped and includes spaced parallel edges 45, 46. The edges 45, 46 can be fitted into selected grooves 44 in order to space the lock-in molding element the proper distance from the border section 27 on the inside of the glass pane 13. Each element of the lock-in molding 17 has a portion 47 that carries glazing material 48 in sealing engagement with the adjacent face of the pane 13.

The edges of the flanges 28, 43 are spaced from each other within the window opening 11 in order to form a thermal break. The sole connection between the frames 15, 16 are the non-metallic clips 18 which are located at the corners of the frames and at widely spaced locations along the edges of the glass panel 13. The non-metallic clips 18 that bridge the gap between the flanges 28, 43 only at spaced locations and serve to connect the frames 15, 16 together are each comprised of a section 55 that engages an edge of the glass pane 13, and four projecting ridges that form a pair of parallel locking grooves 56. The section 55 of the non-metallic clip includes a long leg 57 and a short leg 58. The frame flanges 28, 43 are respectively formed with ribs 60, 61 along the distal edges of the flanges, and these ribs 60, 61 are snapped into the grooves 56.

In use, frames 15, 16 are respectively placed against the outside and inside of the building member 10 and are locked in position by snapping the plastic clips 18 over the locking ribs 60, 61. For installation of one-half or five-eights inch thick panes, the plastic clips 18 are installed by snapping the long leg 57 over locking rib 60 and the short leg 58 over locking rib 61. For installation of three-quarter or one inch thick panes, the plastic clips 18 are installed pointing the other way by snapping short leg 58 over locking rib 60 and long leg 57 over locking rib 61. A pane of insulated glass 13 is inserted into the opening 11 so that it is supported and cushioned by the clips 18 and rests against the border section 27 of the outside frame 15.

As shown in FIG. 3, the snap-in molding 17 is square cut to the required lengths. The horizontal sections of the molding 17 are installed first; then the vertical sections are snapped in to rest on the horizontal sections of the molding 17. Glazing material, such as flexible vinyl strips, are placed in the grooves 32 of the frame 15. Flexible vinyl glazing or other material 48 is then engaged between the snap-in molding and the insulated panel to complete the assembly.

It will be seen from the foregoing that the framing structure 14 is easily assembled without the need of any tools or fasteners. It will also be seen that the oonstruction of the framing 14 provides a complete thermal break between the inside and outside frames 15, 16, respectively. At the same time, the assembly operation can be carried out to accommodate insulated glass panes of varying thickness, e.g., from one-half to one inch.

Many modifications and variations of the invention will become apparent to those skilled in the art in light of the foregoing detailed description. Therefore, it is to be understood that, within the scope of the appended claims, the invention can be practiced otherwise than as specifically shown and described.

I claim:

1. A window framing structure for mounting a window pane in an opening of a building member, said opening bounded by an edge surface connecting generally planar inner and outer surfaces of said building member, said framing structure being adapted to accommodate window panes of various thicknesses and comprising:

(a) a first peripheral frame including:
  (i) an outer perimetrical border section engageable against said planer outer surface of said building member around said opening,
  (ii) a second perimetrical border section integral with said outer perimetrical border section which extends into said opening with said outer perimetrical border section contacting said building member, and
  (iii) a first flange integral with and extending from said perimetrical border sections into said opening against said edge surface, (b) a second peripheral frame including:
  (i) an inner border section engageable against said inner building member surface around said opening, and
  (ii) a second flange integral with and extending from said inner border section into said opening against the edge surface thereof, said flanges of said first and second frames being spaced apart, (c) thermal break clip means for bridging the space between said first and second flanges to hold said frames against the inner and outer surfaces of the said building member, said thermal clip means comprising a plurality of non-metallic members having generally planar window engaging surfaces spaced from flange engaging ridges for holding said first and second perimetrical frames against the inner and outer building member surfaces, said thermal clip separating an installed window pane from said first and second flanges to cushion said window pane; and (d) lock-in molding means carried by said second frame adjacent said window pane, whereby said window pane is held between said lock-in molding and said second border section of said first frame, (e) said lock-in molding means being adjustable toward and away from said second border section to accommodate window panes of different thicknesses.

2. Framing structure as claimed in claim 1 wherein said second border section and said lock-in molding means includes glazing material adopted to seal against said window pane.

3. Framing structure as claimed in claim 1 wherein said second frame includes a plurality of mounting grooves, and said lock-in molding means includes edges engaged in said grooves, whereby said lock-in molding can be adjusted relative to said second border section by positioning said edges in selected grooves.

4. A window framing structure for mounting a window pane in an opening of a building member, said opening bounded by an edge surface connecting generally planar inner and outer surfaces of said building member, said structure being adapted to accommodate window panes of various thickness and comprising:

(a) first peripheral frame elements, each including:
  (i) a first border section engageable against the outer surface of said building member adjacent said opening,
  (ii) a second border section having a web integral with said first border section and a glazing material carrying portion adapted to be placed next to said glass pane, and
  (iii) a flange integral with and projecting at right angles to a plane of said web to extend into said opening against said edge surface, (b) means for connecting said first frame elements together to form a unitary, perimetrical frame, (c) second peripheral frame elements, each including:
  (i) a border section engageable against the inner surface of said building member adjacent said opening, and
  (ii) a flange integral with and projecting from said border section to extend into said opening against the edge surface,
  (iii) a plurality of parallel grooves extending lengthwise of said flange;

(d) means for connecting said second frame elements together to form a perimetrical frame, (e) a lock-in molding element engageable with the flange of each of said second frame elements, each of said lock-in molding elements including:
  (i) a glazing material carrying portion adapted to be placed next to said glass pane,
  (ii) an edge engageable in a selected groove, whereby said molding elements can be adjusted toward and away from said second border sections to accommodate glass panes of different thicknesses, and, (f) a plurality of plastic clips adapted to be placed in locking engagement with said flanges to hold said frames against the inner and outer surfaces of said building member, said clips having surfaces which are placed in supporting engagement with the edges of said window pane spaced from flange engaging ridges of said plastic clips to cushion said window pane from contact with the flange of said first and second peripheral frame elements.

5. A building member and a window framing structure for mounting a window pane in an opening of said building member, said opening bounded by an edge surface connecting generally planar inner and outer building member surfaces, said framing structure being adapted to accommodate window panes of various thicknesses and comprising:

(a) a first peripheral frame including:

(i) an outer perimetrical border section contacting an outer surface of said building member around said opening, (ii) a second perimetrical border section integral with said outer perimetrical border section extending into said opening, and (iii) a first flange integral with and extending from said outer and second border sections into said opening against said edge thereof, (b) a second peripheral frame including:

(i) an inner border section contacting said inner building member surface around said opening, and (ii) a second flange integral with and extending from said inner border section into said opening against the edge surface thereof, said flanges of said first and second frames being spaced apart, (c) thermal break clip means holding said frames against the inner and outer surfaces of the said building member, and (d) lock-in molding means carried by said second frame adjacent said window pane, whereby said window pane is held between said lock-in molding and said second border section of said first frame, (e) said lock-in molding means being adjustable toward and away from said second border section to accommodate glass panes of different thicknesses.

* * * * *